US005161769A

United States Patent [19]

Coulthard

[11] Patent Number: 5,161,769

[45] Date of Patent: Nov. 10, 1992

[54] SAFETY MARKER SUSPENSION DEVICE

[76] Inventor: Robert Coulthard, R.R. #1, Forestburg, Alberta, Canada, T0N 1N0

[21] Appl. No.: 619,394

[22] Filed: Nov. 29, 1990

[30] Foreign Application Priority Data

Apr. 25, 1990 [CA] Canada ..... 2015442

[51] Int. Cl.[5] ..... G09F 17/00

[52] U.S. Cl. ..... 248/599; 116/28 R; 116/173; 248/326; 248/900; 403/229

[58] Field of Search ..... 116/28 R, 173; 248/548, 248/599, 600, 618, 624, 514, 515, 323, 324, 326, 347, 503, 900; 403/291, 229; 404/11; 246/647

[56] References Cited

U.S. PATENT DOCUMENTS

| | | | |
|---|---|---|---|
| 1,013,410 | 1/1912 | Lynch | 403/229 |
| 2,098,388 | 11/1937 | Hruska | 403/229 X |
| 2,321,272 | 6/1943 | Becwar | 248/514 X |
| 2,358,531 | 9/1944 | Orendorff | 403/229 X |
| 2,706,608 | 4/1955 | Joseph | 248/514 X |
| 2,949,324 | 8/1960 | Birge et al. | 248/624 X |
| 3,788,268 | 1/1974 | Hiatt et al. | 116/28 R |
| 3,878,810 | 4/1975 | Conrad | 116/28 R |
| 3,972,302 | 8/1976 | Sherman | 116/28 R |
| 3,999,776 | 12/1976 | Betts, Sr. | 248/624 X |
| 4,081,177 | 3/1978 | Graff | 403/229 X |
| 4,482,122 | 11/1984 | Grashow | 248/514 |
| 4,755,033 | 7/1988 | Whitehead et al. | 248/900 X |
| 5,002,251 | 3/1991 | Kranenberg | 248/503 |
| 5,006,009 | 4/1991 | Griffin | 404/11 |

*Primary Examiner*—Carl D. Friedman
*Assistant Examiner*—Derek J. Berger
*Attorney, Agent, or Firm*—Beveridge, DeGrandi & Weilacher

[57] ABSTRACT

A safety marker suspension device which consists of a rod having a first end and a second end. The first end is attached to a safety marker. A plate is secured transversely to the second end of the rod. A housing is provided having a side wall defining an opening. The opening has a peripheral lip which matingly receives the plate. A spring is secured to and extends between the housing and the plate, thereby resiliently securing the rod to the housing. The housing is attached to machinery.

2 Claims, 2 Drawing Sheets

SAFETY MARKER SUSPENSION DEVICE

The present invention relates to a safety marker suspension device.

BACKGROUND OF THE INVENTION

For the protection of the public, safety markers are required by law when moving wide machinery along public highways. The type of safety marker required (i.e. flag, reflector, or flashing light) depends upon surrounding circumstances, such as conditions of visibility. It is often difficult to permanently suspend a safety marker to such machinery.

By way of illustration, consider agricultural machinery, such as a chisel plow. The chisel plow is made with "wings" which are raised during transport. The plow must be moved from field to field via public highways. The law requires that a safety marker be placed on each side to clearly mark the sides of such wide machinery. In order to move the chisel plow, the wings are raised exposing the "working end" of the plow. In order to fulfill the legal requirements, the farmer is supposed to temporarily attach safety markers to the working end of the agricultural implement. Many farmers do not wish to take the time to make such a temporary installation and as a result accidents are occurring. A permanently installed safety marker is required for such machinery. The problem is that during use the "wings" of the chisel plow move up and down following the contours of the terrain. Any rigidly secured safety marker would be severed by the wing frame. It is for this reason that it has not been thought possible to permanently affix a safety marker to such machinery.

SUMMARY OF THE INVENTION

What is require is a safety marker suspension device which can be permanently installed on machinery having wings.

According to the present invention there is provided a safety marker suspension device which is comprised of a rod having a first end and a second end. The first end has means for attaching a safety marker. A plate is secured transversely to the second end of the rod. A housing is provided having a side wall defining an opening. The opening has a peripheral lip which matingly receives the plate. A spring is secured to and extends between the housing and the plate, thereby resiliently securing the rod to the housing. Means are provided for attachment of the housing to machinery.

BRIEF DESCRIPTION OF THE DRAWINGS

These and other features of the invention will become more apparent from the following description in which reference is made to the appended drawings wherein.

DETAILED DESCRIPTION OF THE PREFERRED EMBODIMENT

Figure 1:
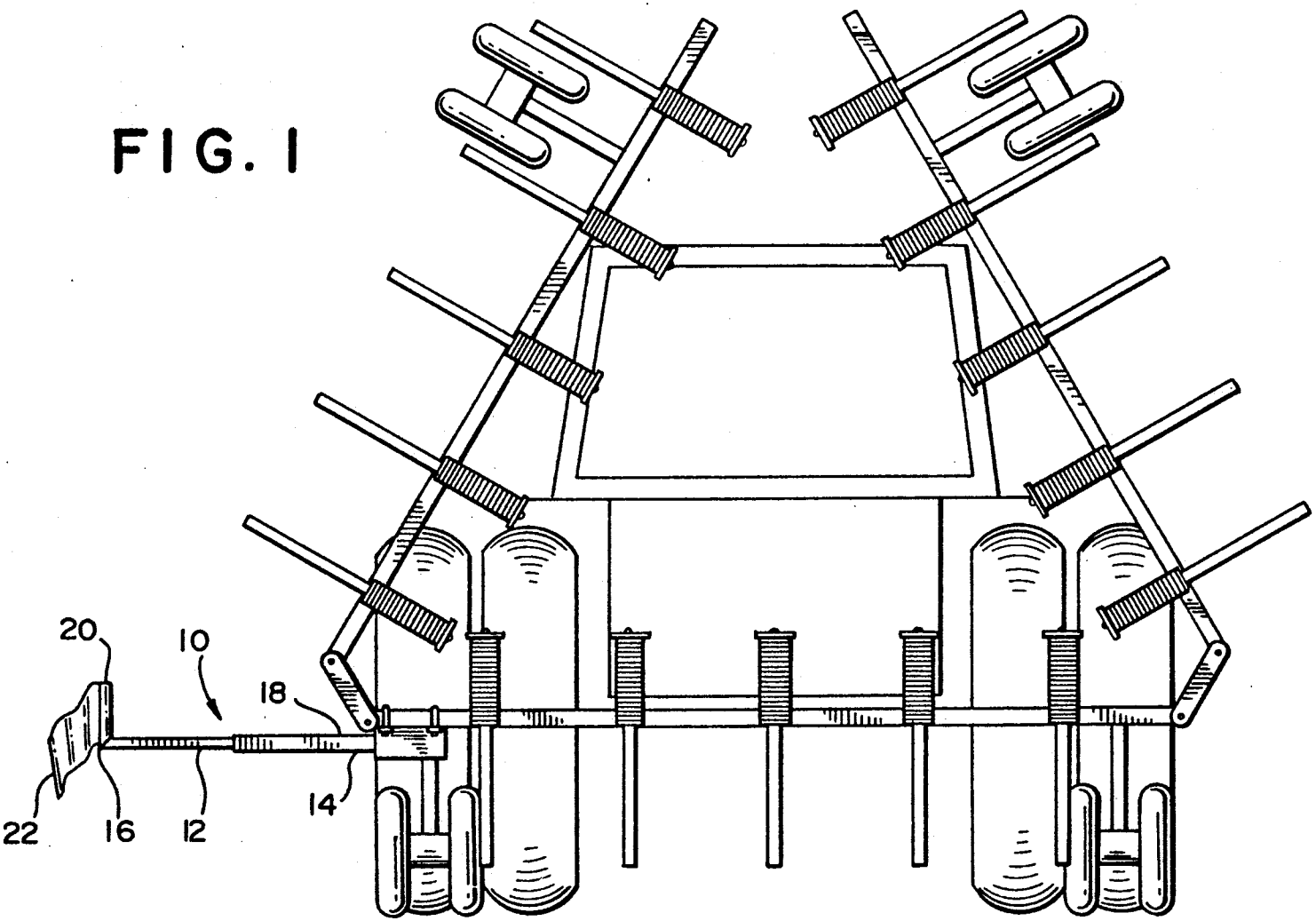
FIG. 1 is a perspective view of a preferred embodiment of the invention, attached to agricultural machinery.
Figure 2:
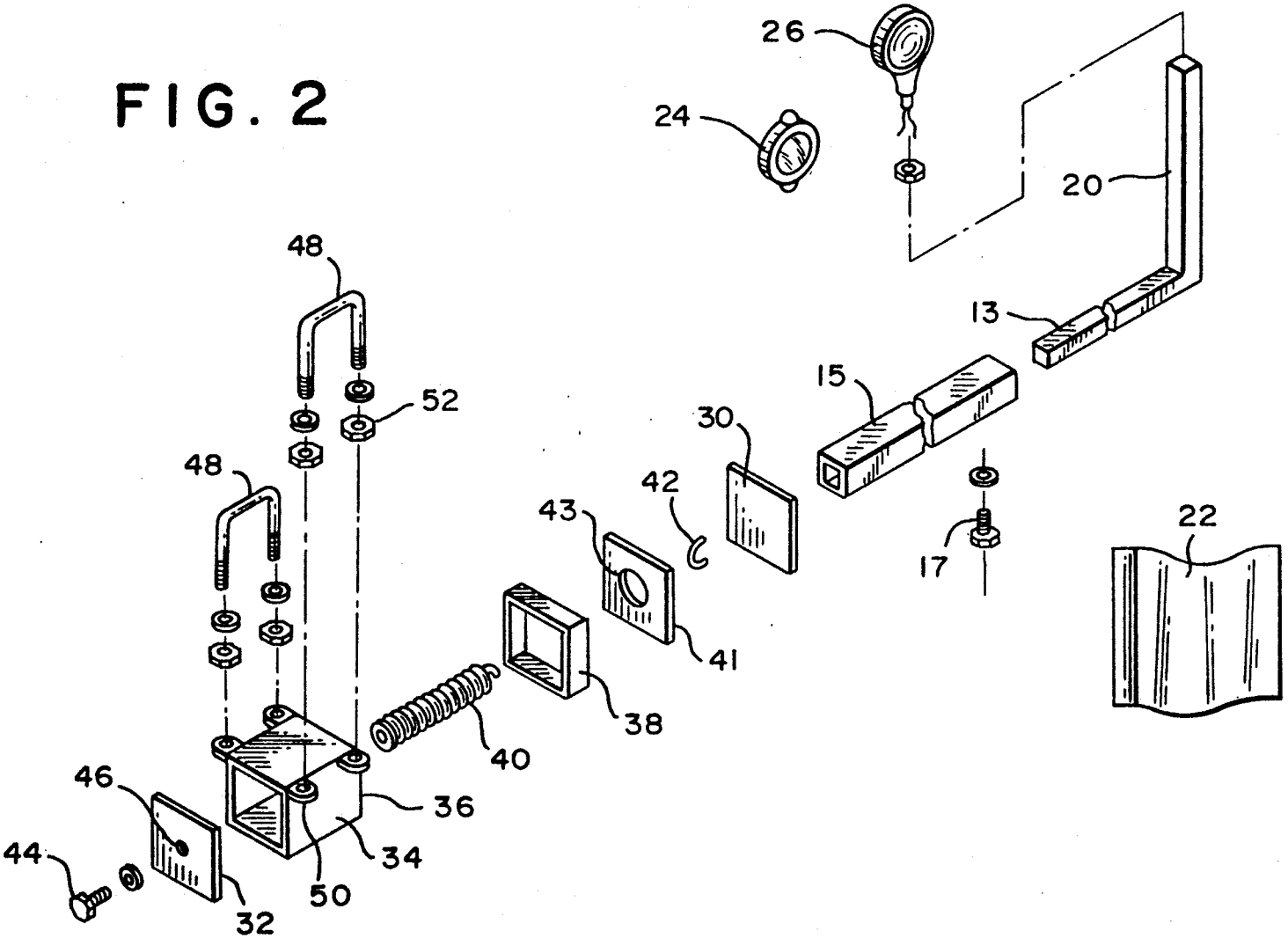
FIG. 2 is an exploded from elevation view of the safety marker suspension device illustrated in FIG. 1.

The preferred embodiment will now be described with reference to FIGS. 1 and 2. The preferred embodiment. generally designated by reference numeral 10, is a safety marker suspension device.

The primary components of safety marker suspension device 10 are a telescopically extendable rod 12 and a cup shaped spring housing 14. Telescopically extendable rod 12 has a first end 16 and a second end 18. The telescopic extension is achieved through the mating of a first section 13 with a second section 15. The respective sections are secured in a selected position by tightening of screw 17. First end 16 has means for attaching a safety marker. The actual means required will vary depending upon the type of safety marker used. In the preferred embodiment illustrated in FIGS. 1 and 2, a vertically extending tubular member 20 is provided. Tubular member 20 is suitable for attachment of a flag 22 or the mounting of a reflector 24. As tubular member 20 is hollow wires can be run through rod 12 and a flashing light 26 threaded into an upper end 28 of tubular member 20. A plate 30 is secured transversely to second end 18 of rod 12. Housing 14 has a bottom 32 and a side wall 34. Sidewall 34 defines an opening 36, opposite bottom 32. Opening 36 has a peripheral lip 38 which matingly receives plate 30. A spring 40 is secured to and extends between bottom 32 of housing 14 and plate 30. The means for attachment of spring 40 can vary. In the preferred embodiment a clip 42 which has been welded on plate 30 receives spring 40, and a blot 44 which extends through a hole 46 in bottom 32 secures the other end of spring 40. A plate 41 having a hole 43 large enough to accommodate spring 40, is used to assist in centering spring 40. The means used for attachment of housing 14 to machinery are "U" bolts 48 which extend through brackets 50 welded to housing 14, and are secured against removal by nuts 52.

The use and operation of safety marker suspension device 10 will now be described which reference to FIGS. 1 and 2. As illustrated in FIG. 1, safety marker suspension device 10 is secured to machinery. In order to do this "U" bolts 48 are placed around a portion of the frame of such machinery spaced in from the wings, and then nuts 52 are tightened to secure "U" bolts 48 from removal from brackets 50 on housing 14. Rod 12 is then extended beyond the side of the machinery after it's wings are raised by sliding section 13 in relation to section 15. Rod 12 is secured in the desired telescopically extended position by tightening screw 17. As the machinery proceeds down the highway rod 12 will support the safety marker in a rigid and clearly visible position. When the machinery arrives at its destination, the wings are lowered and cultivating operations may resume without removing safety marker suspension device 10. When the operator uses the machinery in the field, the manner in which spring 40 secured plate 30 at second end 18 of rod 12 to housing 14 permits rod 12 to bend downwardly in response to pressure from the wing and yet resiliently return to a horizontal position when the wing is raised.

It will be apparent to one skilled in the art that safety marker suspension device 10, resolves the problem of permanently securing safety markers to agricultural implements having wings. It will also be apparent to one skilled in the art that modifications may be made to the preferred embodiment illustrated without departing from the spirit and scope of the invention. In particular, the structure of the spring housing can be modified depending upon the type of spring used.

The embodiments of the invention in which an exclusive property or privilege is claimed are defined as follows:

1. A safety marker suspension device, comprising:

a. a rod having a first end and a second end, the first end having means for attaching a safety marker;

b. a plate secured transversely to the second end of the rod;

c. a housing having a side wall defining an opening, the opening having a peripheral lip which matingly receives the plate, a spring being secured to and extending between the housing and the plate, thereby resiliently securing the rod to the housing; and d. means for attachment of the housing to machinery.

2. A safety marker suspension device as defined in claim 1, the rod being comprised of first section which matingly receives a second section, thereby permitting telescopic extension of the rod.

* * * * *